United States Patent [19]

Rialdi

[11] 4,100,093

[45] Jul. 11, 1978

[54] COMPOSITIONS FOR THE TREATMENT OF GLASS SURFACES

[76] Inventor: Giorgio Rialdi, via Padre Semeria 18, Genova, Italy

[21] Appl. No.: 729,156

[22] Filed: Oct. 4, 1976

[30] Foreign Application Priority Data

Apr. 1, 1976 [IT] Italy ..... 21827 A/76

[51] Int. Cl.[2] ..... C11D 7/24; C11D 7/50

[52] U.S. Cl. ..... 252/89 R; 252/317; 252/364; 252/DIG. 2; 252/DIG. 3; 252/DIG. 14

[58] Field of Search ..... 252/DIG. 10, 89 R, DIG. 2, 252/DIG. 3, DIG. 14, 317, 364

[56] References Cited

U.S. PATENT DOCUMENTS

| | | | |
|---|---|---|---|
| 309,622 | 12/1884 | Herrick | 252/DIG. 10 |
| 3,819,522 | 6/1974 | Zmoda et al. | 252/DIG. 10 |
| 3,856,695 | 12/1974 | Geiss et al. | 252/DIG. 10 |

*Primary Examiner*—Thomas J. Herbert, Jr.

*Attorney, Agent, or Firm*—Fitzpatrick, Cella, Harper & Scinto

[57] ABSTRACT

The invention relates to glass surface treating compositions which comprise, in an aqueous vehicle, liquid hydrocarbons, ammonium hydroxide, polyisopropylene gum, monovalent alcohols, castor oil and silica gel.

3 Claims, No Drawings

COMPOSITIONS FOR THE TREATMENT OF GLASS SURFACES

The present invention relates to glass surface treating compositions. More particularly, the invention relates to compositions by which, after the glass is cleaned, it is left thereon an antifogging and water-repellant film.

In general, the products for the maintenance of glass surfaces fall under one of the following classifications:

(1) Detergents
(2) Detergents-abrasives
(3) Antifogging agents
(4) Agents which form a water-repellant film.

There have been and there are on the market formulations of good efficacy falling under the first two classifications. Products falling under the third classification have generally been less efficient. Finally, those falling in the fourth group have had less than modest success.

Attempts have been made to produce a product which would have the combined action of all four types of products classified above but such attempts have been unsuccessful. The main obstacle in obtaining a suitable product is the incompatibility between the detergent-abrasive action of the second classification and the film-forming effect of the fourth classification. Said incompatibility has never been resolved and it has always been thought that the two above-mentioned actions could not coexist in the same formulation.

In the past, therefore, in order to obtain a complete treatment of a glass surface there were involved a sequence of steps, namely, the cleaning of the glass followed by the application thereon of a film having antifogging and water-repellant properties. Such practice, aside from being time-consuming and consequently expensive did not always yield the desired results due to the poor quality and effectiveness of the final film.

The products discussed above consist generally of various combinations of two or more ingredients such as ethanol, isopropanol, acetone, water, kerosene, glycols, polyglycols, glycerin, sodium hydroxide, oxalic acid, chromates, aluminates, and various surfactants. The most well-known of such combinations is a solution of colored water and isopropanol, with or without surfactants, which still to-day represents the most used formulation.

To overcome the above-mentioned prior art difficulties, the present invention relates to compositions which possess detergent and abrasive properties and which will also leave an antifogging and water-repellant film on the glass surfaces on which they are applied. These compositions rely on the combinations of various components which have a synergistic action on each other rather than interfering with each other. In other words, the present compositions will possess all the four properties classified hereinbefore.

Broadly, the compositions comprise the following substances, which will be more fully identified hereinafter, the percentages being expressed on a weight by weight basis:

| | |
|---|---|
| Liquid hydrocarbons | 9 - 13% |
| Polyisopropylene gum | 0.2 - 0.5% |
| Monovalent alcohols | 18 - 25% |
| Castor oil | 4 - 8% |
| Silica gel | 2 - 6% |
| Ammonium hydroxide | 0.05 - 0.2% |

-continued

| | |
|---|---|
| Water | 40 - 60% |

In following a suitable method of preparing the compositions of the present invention, there is first prepared a solution of concentrated ammonium hydroxide in water in a ratio of about 0.1 : 1.

There is then prepared an aqueous solution of one or more monovalent saturated alcohols having 3 or 4 carbon atoms. The suitable alcohols are the following:

*n* — propyl alcohol isopropyl alcohol
2 — methyl - n - propyl alcohol
*n* — butyl alcohol
Sec — butyl alcohol
*t* — butyl alcohol A combination of up to three of the above alcohols can be used in the present compositions. The alcohol-water ratio is about 0.4 : 1.

These alcohols are characterized by the following features:

(a) their resistance to oxidation
(b) their solvent action with respect to the polyisopropylene gum, and
(c) their boiling points which range from 79° to 120° C.

It is then prepared a solution of polyisopropylene gum in a suitable solvent in a ratio of 0.02 : 1.

The polyisopropylene gum preferred in a practice of the invention is the natural polyisopropylene gum isolated from the rubber tree (*H. brasilensis*) while the polyisopropylene gums obtained synthetically are less preferred.

When one polymerizes a conjugated diene, such as butadiene or isoprene, each unitary element possesses a double bond, which can be internal or external. In the case of the natural polyisopropylene gum, such double bonds are internal and it is this feature which seems to give said gum its preferred characteristics. The synthetic polyisopropylene gums, on the other hand, are a mixture of many steric forms. Such steric difference is important and determines the positive or negative characteristics of the product.

The solubilization of the gum is obtained by a suitable medium. A solvent capable of effecting such solubilization at low temperature, and also to maintain said gum in solution when the remaining acqueous and alcoholic solutions forming part of the compositions are finally admixed, is a liquid hydrocarbon having a boiling point in the range of from + 29° C to + 199° C. The degree of unsaturation of said hydrocarbon, as well as the degree of isomerization, are instrumental in determining said boiling points. Among representative compounds there can be mentioned methylbutadiene (b.p. 34° C), pentane (b.p. 36.2° C) and isopentane (b.p. 31° C). Other higher liquid hydrocarbons having boiling points within the desired range are equally operable.

At this point of the process, the monovalent alcohol solution is added to the aqueous ammonium hydroxide solution with stirring and is then added thereto the polyisopropylene solution, in a ratio of 0.02 : 1.

Inasmuch as it is desired to obtain a final product having antifogging and water-proofing properties, there is added to the above-obtained composition a fatty component which is highly compatible therewith and which will give to said composition film-forming characteristics. It has been found that a most preferred compound is castor oil. Hydrogenated castor oil or polymers of castor oil are also suitable. The amount of castor oil to be added to the composition thus far obtained is in the ratio of about 0.06 : 1.

To the liquid composition is then added micronized silica gel, in an amount ranging from 2 to 6 percent by weight, based on the weight of the liquid composition. Such addition is performed with strong mechanical stirring and under reduced pressure.

At this point, during the addition of the silica gel, the composition, which has reached its final stage, has taken a colloidal appearance and is ready for use.

It should be noted that all the components hereinbefore indicated are essential and perform their function, either by themselves and/or by synergizing the effect of other components, in obtaining a final product having all the desired characteristics.

It is to be pointed that the percentage of the components can be varied within the ranges set forth at the beginning of the specification to change the physical characteristics of the final products, which can be from almost liquid to almost pasty.

It is to be further noted that, in its correct use, the present products are not harmful to humans, to animals, to plants or the environment.

What is claimed is:

1. A glass surface treating composition which comprises, in intimate admixture:

(a) 0.2–0.5% of a polyisopropylene gum;
(b) 18–25% of a monovalent saturated alcohol having from 3 to 4 carbon atoms;
(c) 9–13% of a liquid hydrocarbon having a boiling point of from 31° C to 36.2° C. and being capable of solubilizing said polyisopropylene gum and maintaining said gum in solution;
(d) 4–8% of a fatty compound selected from the group consisting of castor oil, hydrogenated castor oil and polymerized castor oil;
(e) 2–6% of silica gel;
(f) 0.05–0.2% of ammonium hydroxide; and
(g) 40–60% of water, all percentages being expressed in parts percent by weight.

2. The composition of claim 1 wherein the liquid hydrocarbon is selected from the group consisting of methylbutadiene, pentane, and isopentane.

3. The composition of claim 1 wherein the polyisopropylene gum is a natural gum obtained from the tree *H. brasilensis.*

* * * * *